US005556181A

United States Patent [19]

Bertrand

[11] Patent Number: 5,556,181

[45] Date of Patent: Sep. 17, 1996

[54] ADJUSTABLE LEVEL PLAY DESK FOR A CHILD

[75] Inventor: Victor J. Bertrand, Ile Bizard, Canada

[73] Assignee: The Ritvik Group Inc., Quebec, Canada

[21] Appl. No.: 445,021

[22] Filed: May 22, 1995

[30] Foreign Application Priority Data

Jan. 24, 1995 [CA] Canada ..... 2140940

[51] Int. Cl.[6] ..... A47B 77/10

[52] U.S. Cl. ..... 312/313; 312/194; 312/195; 312/257.1; 108/14; 108/25; 108/26; 108/144; 248/188.1; 403/104

[58] Field of Search ..... 312/194, 195, 312/277, 127, 313, 293.1; 108/12, 14, 25, 26, 110, 144; 248/188.1, 188.8, 188.2, 188.6; 403/109, 377, 104

[56] References Cited

U.S. PATENT DOCUMENTS

| | | | |
|---|---|---|---|
| 3,566,816 | 3/1971 | Zilg et al. | 108/14 X |
| 3,645,595 | 2/1972 | Urquhart et al. | 312/195 X |
| 3,865,050 | 2/1975 | Cecchetti | 248/188 X |
| 4,057,244 | 11/1977 | Gaspar | 108/25 X |
| 4,427,391 | 1/1984 | Berman | 108/26 X |
| 4,793,611 | 12/1988 | Thornell | 403/104 X |
| 4,807,538 | 2/1989 | Hoffman | 108/25 |
| 4,852,837 | 8/1989 | Merten et al. | 248/188 X |
| 5,125,646 | 6/1992 | Wildinson | 108/144 X |
| 5,218,912 | 6/1993 | Buske | 108/14 X |
| 5,244,271 | 9/1993 | Hackwood et al. | 312/257.1 X |
| 5,299,861 | 4/1994 | Foliot et al. | 312/194 |

FOREIGN PATENT DOCUMENTS

| | | | |
|---|---|---|---|
| 3337062 | 5/1985 | Germany | 312/194 |
| 2267030 | 11/1993 | United Kingdom | 248/188.1 |

*Primary Examiner*—Peter M. Cuomo
*Assistant Examiner*—Rodney B. White
*Attorney, Agent, or Firm*—Michael D. Bednarek; Kilpatrick & Cody

[57] ABSTRACT

The adjustable level play desk is for a child. It comprises at least three elongated legs of substantially circular cross section, each of the legs having a lower end for resting on the ground and an outer cylindrical surface provided with a first locking device; and a top body having an upper play surface, and at least three sleeves oriented downwardly when in use, the sleeves being for slidably receiving respectively the legs, the sleeves being solid with the top body at positions providing steadiness thereof. Each of the sleeves has a lower opening for receiving the corresponding leg, and an inner cylindrical surface provided with a second locking device for removably engaging with the first locking device of the corresponding leg upon a predetermined rotation thereof to lock the corresponding leg with respect to the sleeve, and a guiding device for guiding the corresponding leg along a longitudinal direction of the sleeve, whereby, in operation, the play surface is adjusted with respect to the child according to a given level by sliding and locking the legs with respect to the sleeves.

20 Claims, 15 Drawing Sheets

ADJUSTABLE LEVEL PLAY DESK FOR A CHILD

FIELD OF THE INVENTION

The present invention is concerned with an adjustable level play desk for a child.

BACKGROUND OF THE INVENTION

In the art, there is no adjustable play desk where the play surface can be adjusted with respect to the child as it grows in a simple manner.

OBJECT OF THE PRESENT INVENTION

It is an object of the present invention to provide an adjustable play desk for a child where the play surface can be adjusted with respect to the child as it grows in a simple manner.

SUMMARY OF THE INVENTION

According to the present invention, there is provided an adjustable level play desk for a child, comprising:

at least three elongated legs of substantially circular cross section, each of the legs having a lower end for resting on the ground and an outer cylindrical surface provided with first locking means;

a top body having an upper play surface, and at least three sleeves oriented downwardly when in use, the sleeves being for slidably receiving respectively the legs, the sleeves being solid with the top body at positions providing steadiness thereof, each of the sleeves having:

a lower opening for receiving the corresponding leg, and an inner cylindrical surface provided with second locking means for removably engaging with the first locking means of the corresponding leg upon a predetermined rotation thereof to lock the corresponding leg with respect to the sleeve, and a guiding means for guiding the corresponding leg along a longitudinal direction of the sleeve, whereby, in operation, the play surface is adjusted with respect to the child according to a given level by sliding and locking the legs with respect to the sleeves, Further objects, advantages and other features of the present invention will become more apparent upon reading of the following non-restrictive description of preferred embodiments thereof given for the purpose of exemplification only with reference to the accompanied drawings.

DETAILED DESCRIPTION OF THE DRAWINGS

Figure 1:
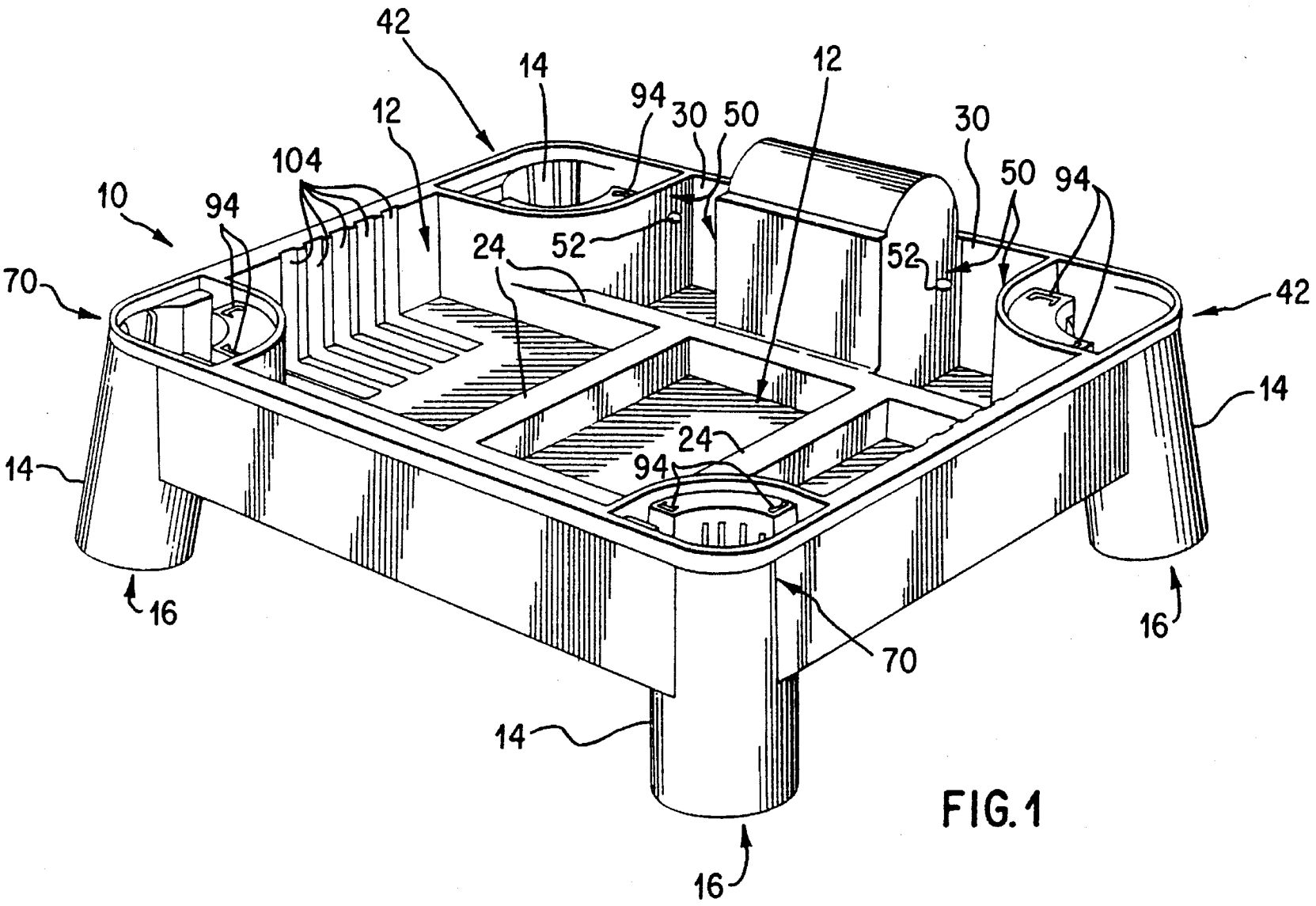
FIG. 1 is a perspective view of the top body of an adjustable level play desk for a child, according to the present invention.

Referring now to FIGS. 1, 2, 4, 5, 6, 7, 8, 9, 13, 14, 15 and 17, there is shown an adjustable level play desk for a child. The play desk comprises four elongated legs 2 of substantially circular cross section. Each leg 2 has a lower end 4 for resting on the ground and an outer cylindrical surface 6 provided with first locking means. Preferably, these first locking means comprise four aligned, spaced apart locking buttons 8 outwardly projecting from the outer cylindrical surface 6 along a longitudinal direction thereof.

Figure 2:
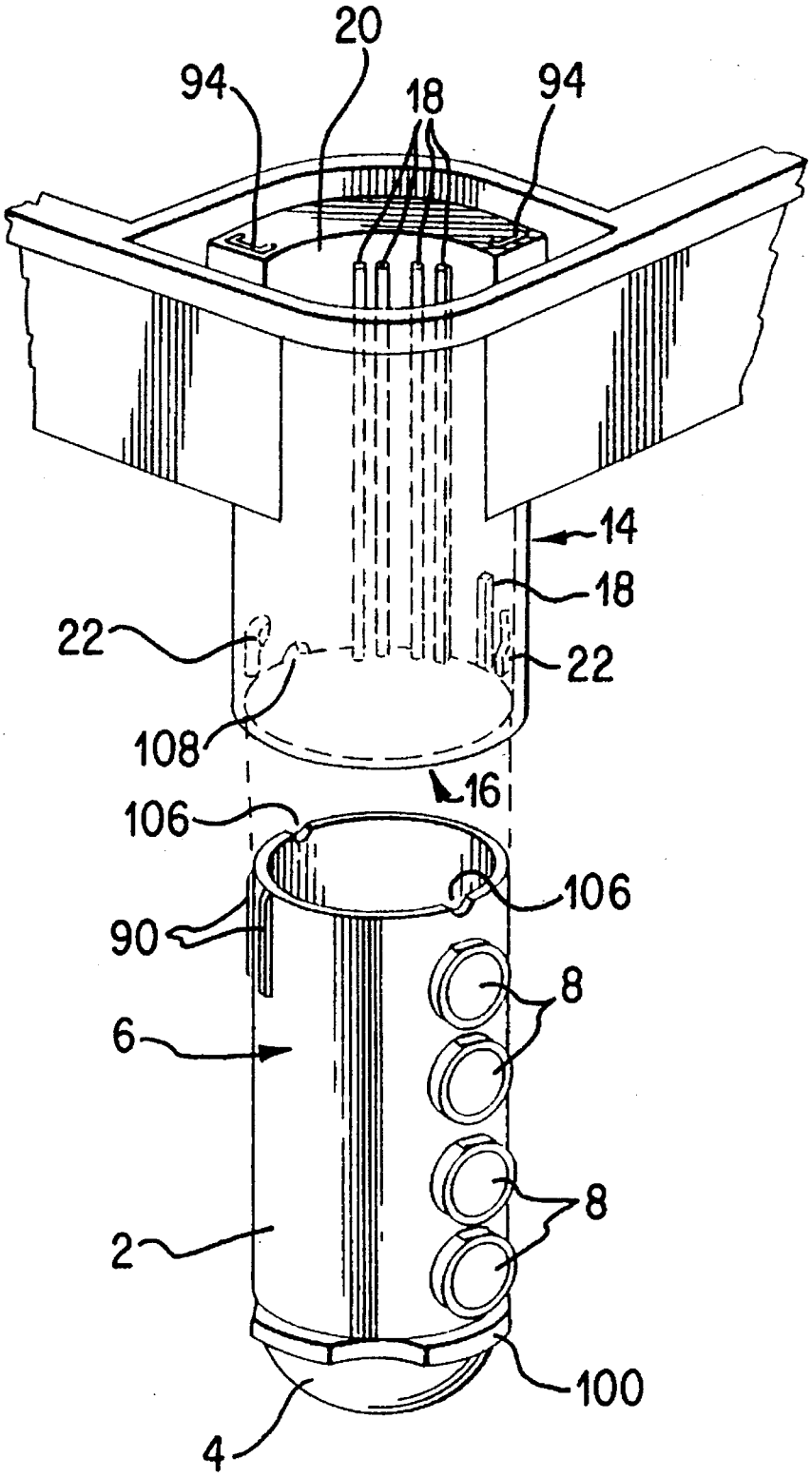
FIG. 2 is a perspective schematic view illustrating how one leg of the desk shown in FIG. 1 cooperates the corresponding sleeve.
Figure 3:
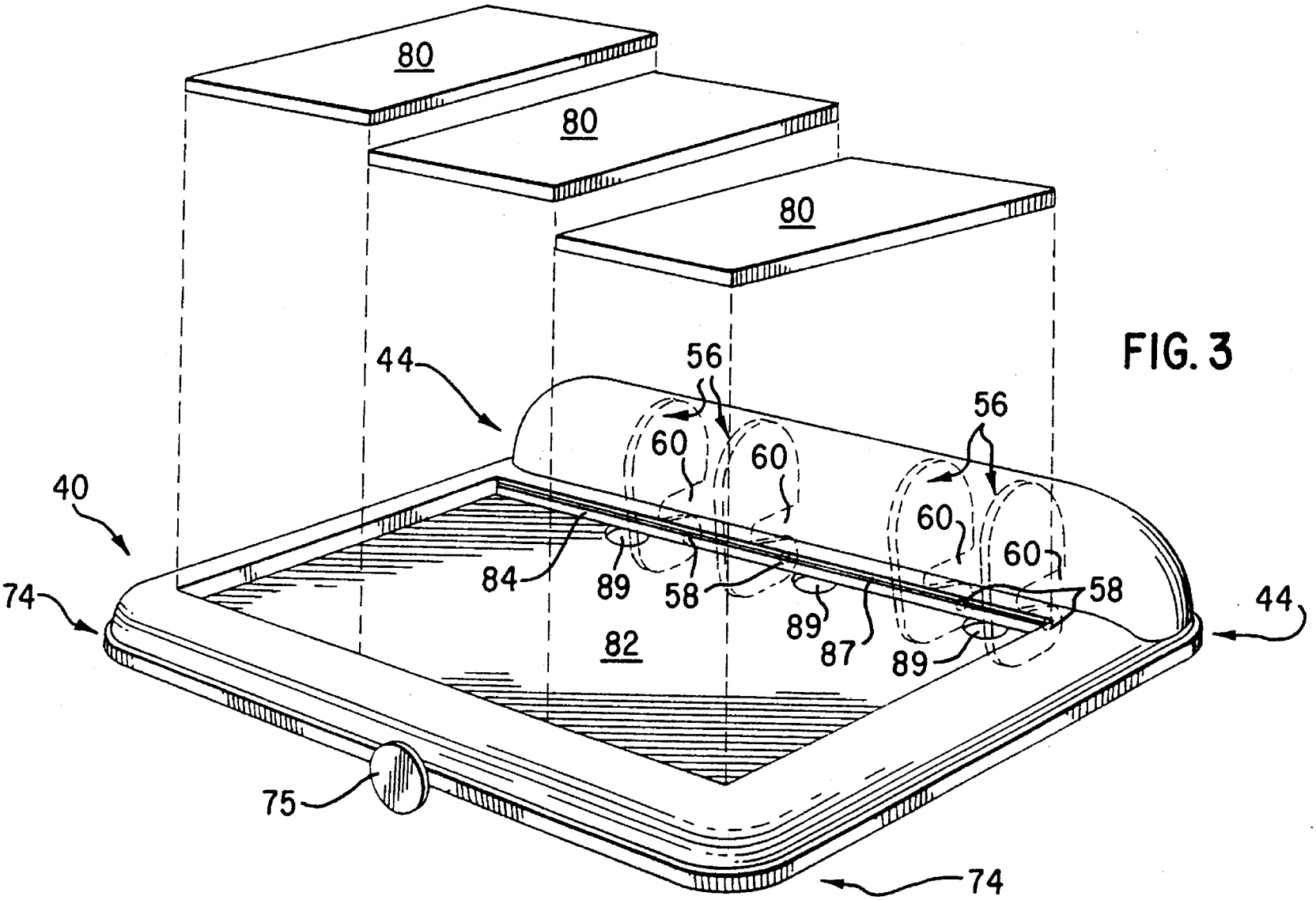
FIG. 3 is a perspective view showing a lid for the desk shown in FIG. 1.

The play desk also comprises a top body 10 having an upper play surface 12, and four sleeves 14 oriented downwardly when in use. The sleeves 14 are for slidably receiving respectively the legs 2 as shown in FIG. 2. The sleeves 14 are solid with the top body 10 at position providing steadiness thereof.

Each sleeve 14 has a lower opening 16 for receiving the corresponding leg 2 and an inner cylindrical surface 20 provided with second locking means for removably engaging with the first locking means of the corresponding leg 2. Upon a predetermined rotation of the leg 2 with respect to the corresponding sleeve 14, they are locked together. Each sleeve 14 also has a guiding means for guiding the corresponding leg 2 along a predetermined longitudinal direction of the sleeve 14. Preferably, the guiding means comprise parallel, spaced apart ribs 18 outwardly projecting from the inner cylindrical surface 20 and extending along a longitudinal direction thereof for restricting the buttons 8 along a predetermined path. The predetermined path is wide enough to allow the predetermined rotation of the leg 2 with respect to the sleeve 14.

Preferably, the second locking means comprise at least one flange 22 outwardly projecting from the inner cylindrical surface 20 and located within the predetermined path. Strengthening cells 17 are provided to strengthen the top body 10.

Figure 16:
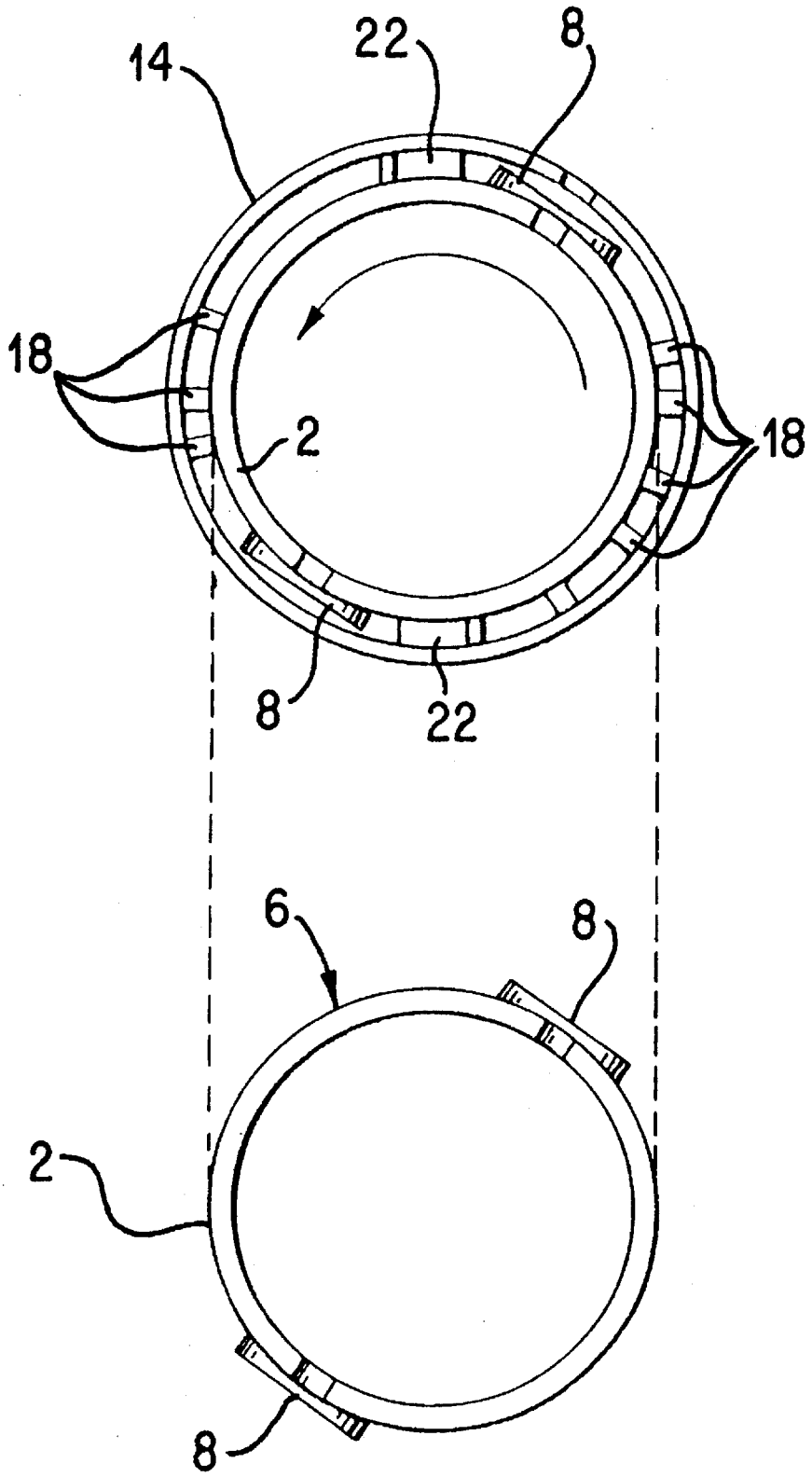
FIG. 16 is a schematic two-part figure showing in its upper part a top view of the male and female parts of FIG. 2, and in its lower part a top view of the male part.
Figure 17:
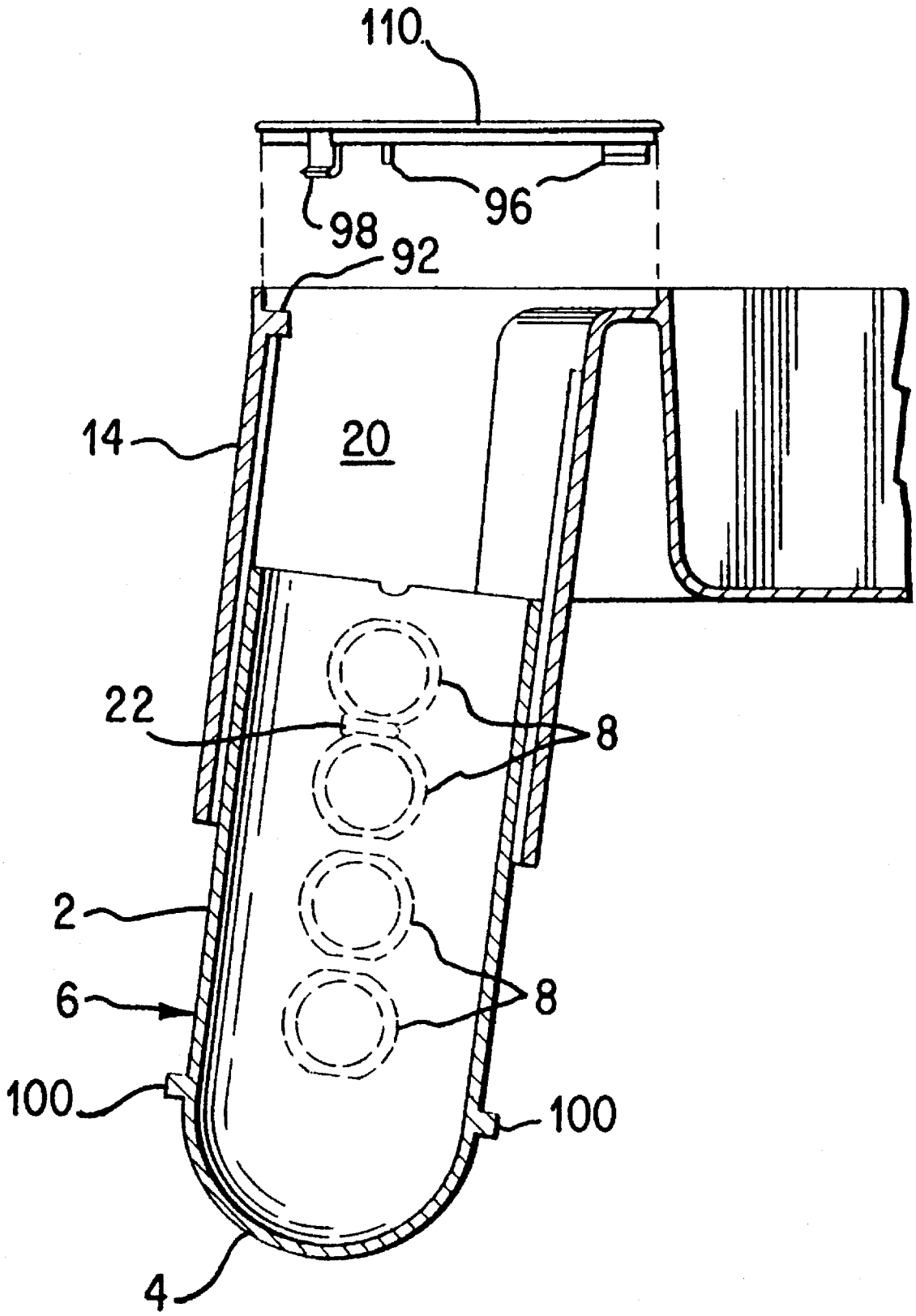
FIG. 17 is a two-part figure showing in its lower part a cross section view of the male arid female parts shown in FIG. 16 in a different operating position, and in its upper part a side view of a cover.

In FIGS. 2, 16 and 17, two opposite flanges 22 are shown. Each flange 22 has a narrow portion corresponding substantially to a distance between two adjacent buttons 8. In use, one leg 2 is slid into the corresponding sleeve 14 by sliding a row of the buttons 8 along the predetermined path of the sleeve 14, and the leg 2 is locked with respect to the sleeve 14 by circumferentially sliding the buttons 8 to lock each of the opposite flanges 22 between two adjacent buttons 8 as shown respectively in FIGS. 16 and 17. Accordingly, in operation, the play surface is adjusted with respect to the child according to a given level by sliding and locking the legs 2 with respect to the sleeves 14.

Referring again to FIGS. 2, 16 and 17, as there are four buttons 8 in a row, the leg 2 can be locked in three positions. Also, in FIG. 16, it can be seen that the leg 2 is provided with two opposite rows of buttons 8, and the sleeve 14 is provided with two opposite flanges 22 to better secure each locking position of the leg 2 with respect to the sleeve 14. Also, the buttons 8 can be provided respectively with different color stickers to easily identify in which position each leg 2 is locked. In use, the legs 2 are not necessarily locked at the same height. For example, the front legs 2 can be locked at a height which is lower than the one at which the rear legs 2 are locked to give a slope to the upper play surface 12.

Preferably, the lower end of the sleeve 14 and the upper end of the leg 2 are provided respectively with notches 106 and 108. These notches 106 and 108 constitute visual marks by which the user aligns the leg 2 with respect to the corresponding sleeve 14 before its insertion therein. A stop 100 is provided on each leg 2 to prevent that the leg 2 be completely inserted into the corresponding sleeve 14. Covers 110 are provided for covering the upper ends of the sleeves 14. Each cover 110 is provided on its lower or interior surface with hooks 96 and 98. The hooks 96 are inserted into the U-shaped slots 94 by forcing them into slots which are momentarily bent out of shape to allow introduction of the looks 96 therein. Then, a downward pressure is applied on the cover 110 to insert the hook 98 underneath the stop 92. To remove a cover 110, the user applies an upward force on the portion of the cover between the looks 96, the slots 94 are then momentarily bent out of shape to extract the hooks 96 therefrom.

Referring again to FIG. 1, preferably the upper play surface 12 is substantially square and is inwardly projecting in the top body 10 to form a substantially square containing section with an open top. The containing section has a depth of one inch for containing for example a plurality of toy blocks. The upper play surface 12 is provided with longitudinal and transversal upwardly projecting flanges 24 to strengthen the top body. The play surface 12 is also provided with lateral strengthening flanges 104.

Figure 14:
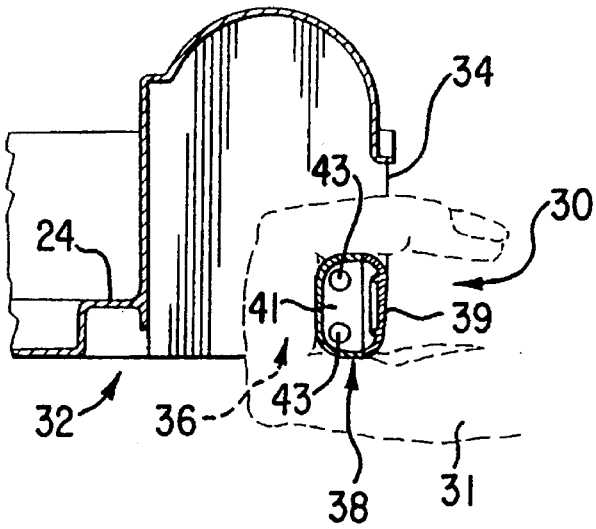
FIG. 14 is a cross section view along lines 14—14 of FIG. 4.
Figure 15:
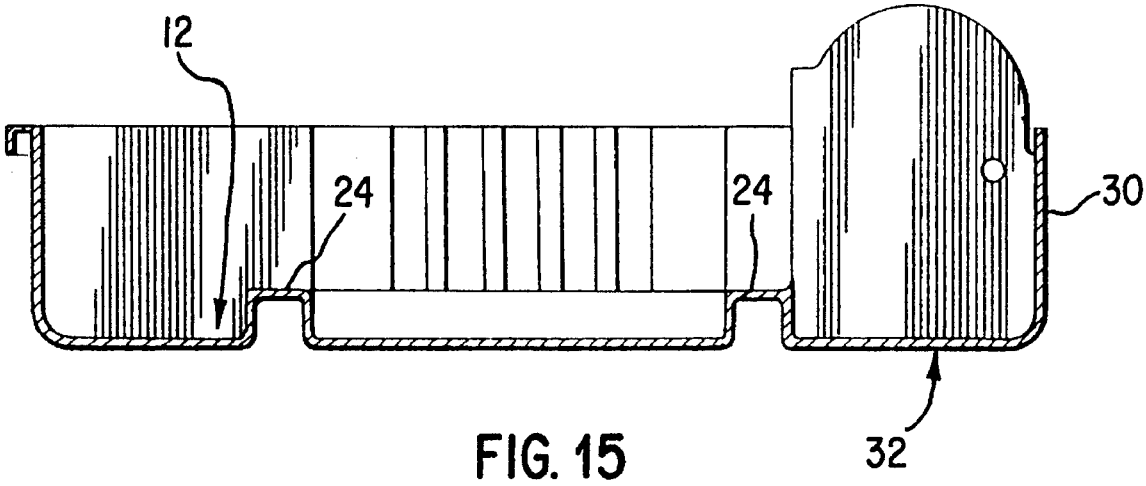
FIG. 15 is a cross section view along lines 15—15 of FIG. 4.

Referring now more specifically to FIG. 14, preferably, the top body has a back wall 30 and a bottom wall 32. The back wall 30 has a central portion provided with a first outer opening 34 having appropriate dimensions for receiving a hand 31 of the child. The bottom wall 32 has also a central portion adjacent to the central portion of the back wall 30, provided with a second outer opening 36 distal from the first opening 34 so that a handle 38 which is between the first and second openings 34 and 36 is formed for carrying the desk. The handle 38 is made of two parts. The first part 39 is made by a portion of the back wall 30, which is between the first and second openings 34 and 36. The second part 41 is adjacent to the first part 39 and is fitted into position by means of pins 43 which are received into tight recesses.

Figure 4:
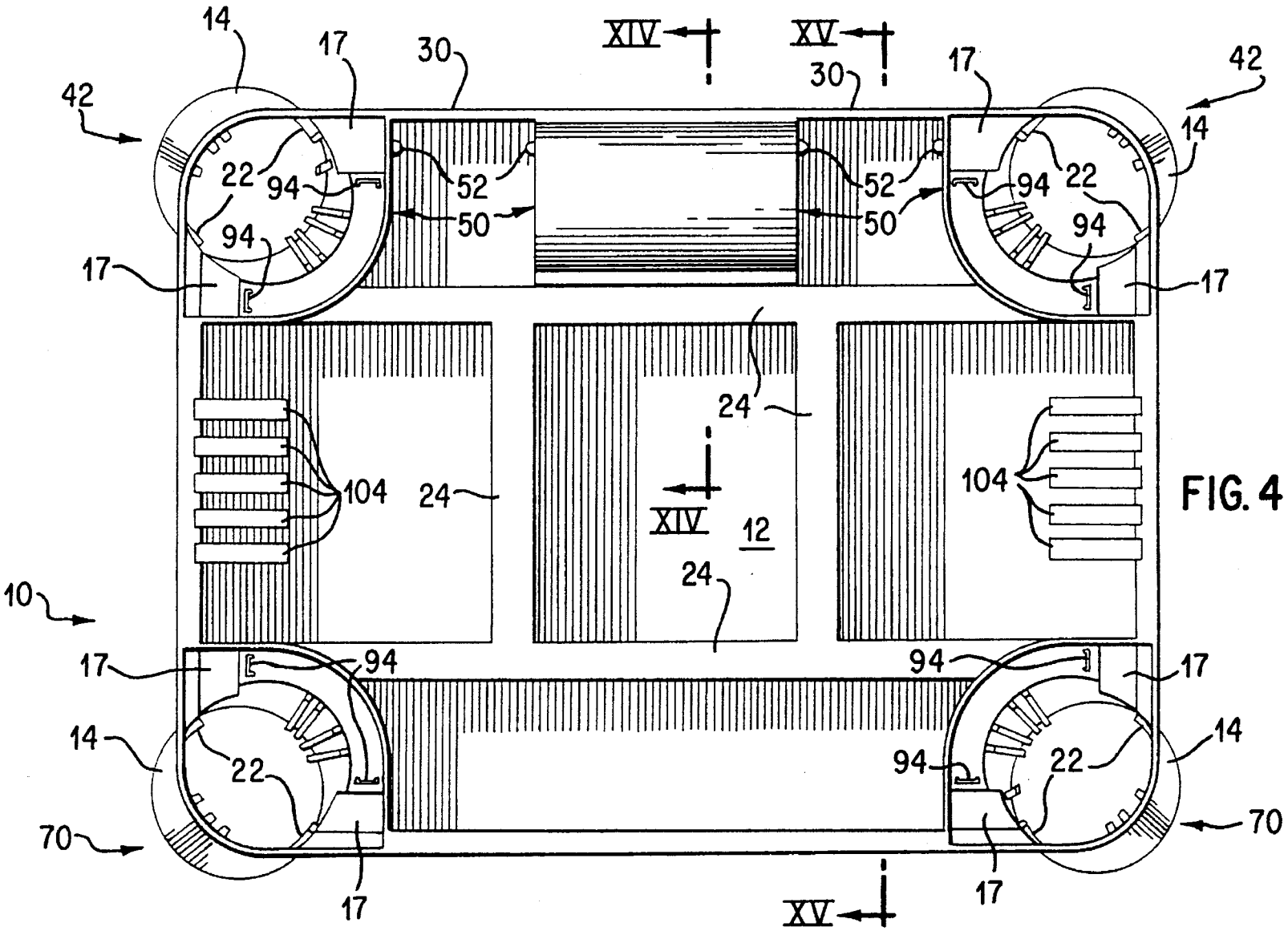
FIG. 4 is a top view of the top body shown in FIG. 1.
Figure 5:
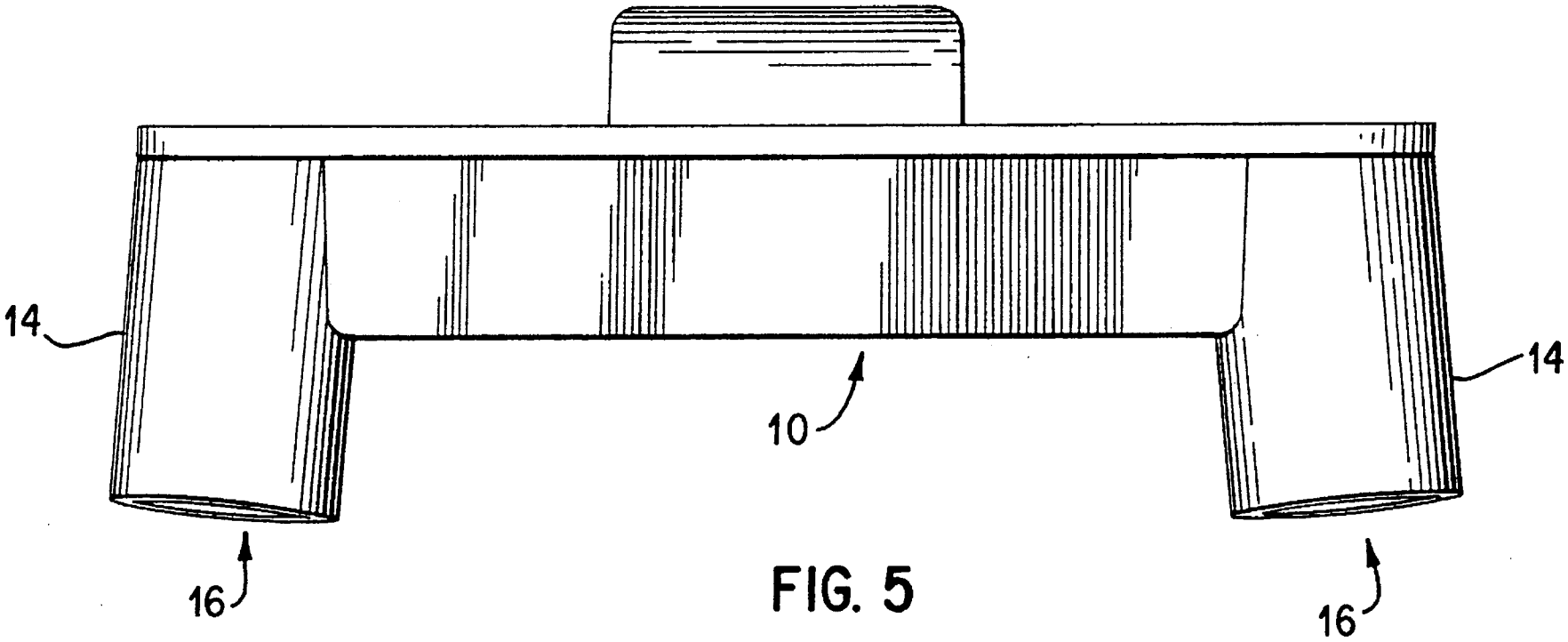
FIG. 5 is a front view of the top body shown in FIG. 1.
Figure 6:
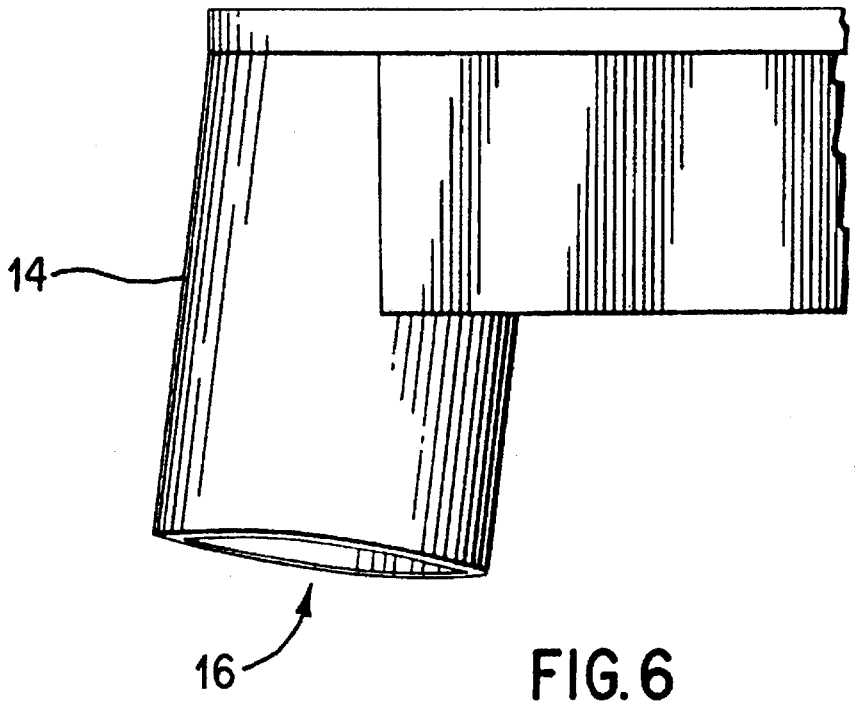
FIG. 6 shows a detail of FIG. 5.
Figure 7:
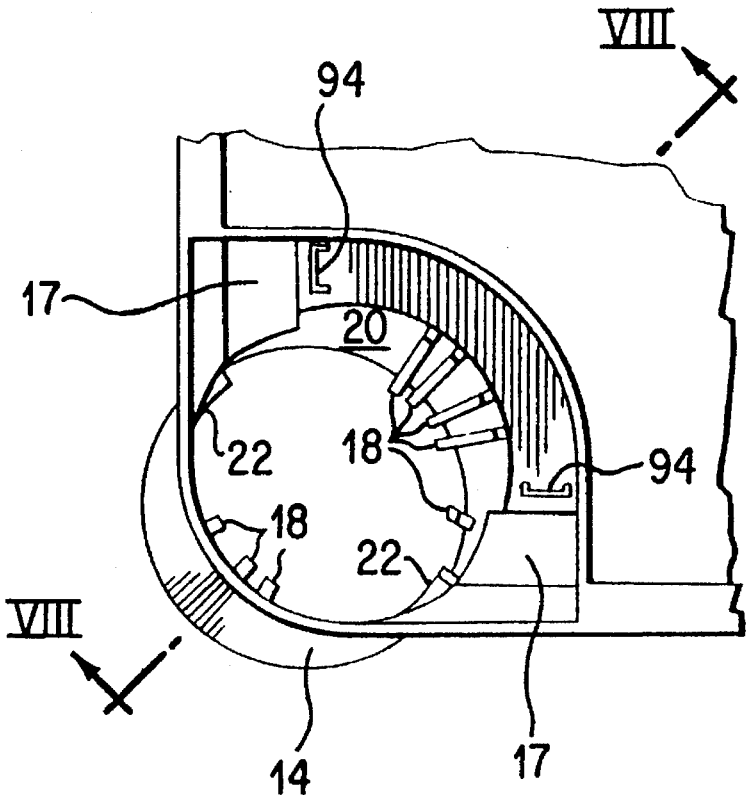
FIG. 7 is a top view of what is shown in FIG. 6.
Figure 8:
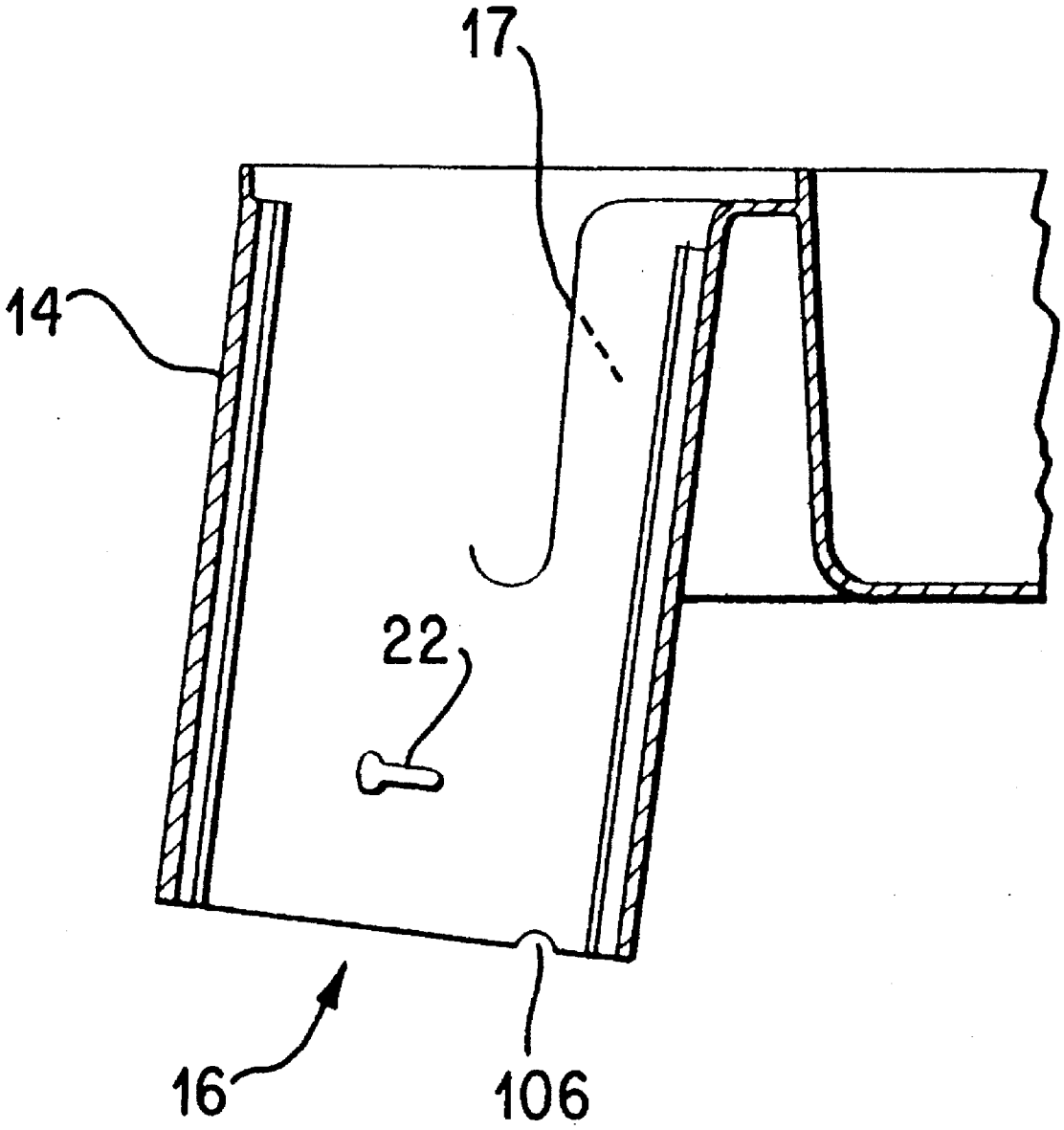
FIG. 8 is a cross section view along lines 8—8 of FIG. 7.
Figure 9:
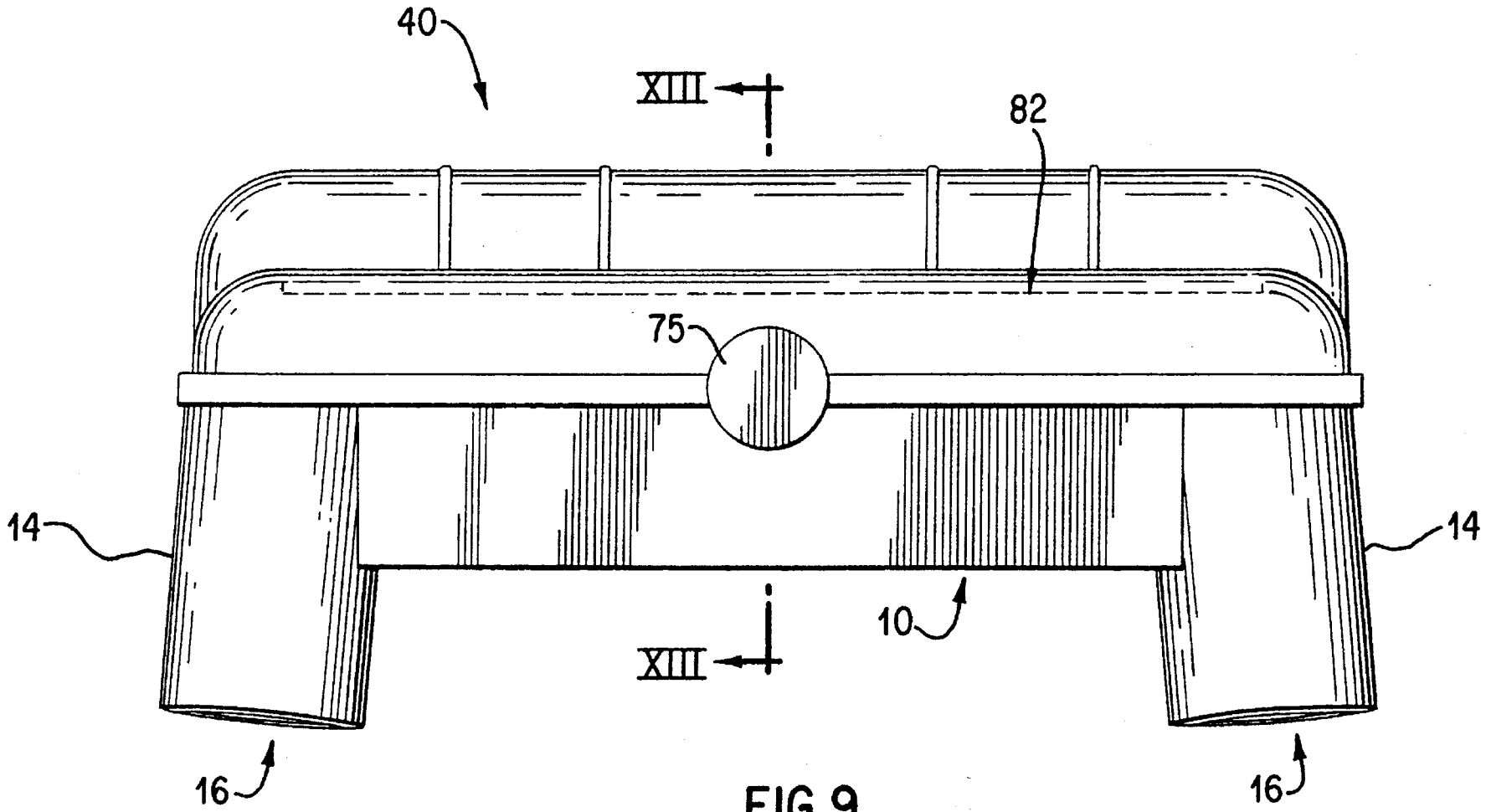
FIG. 9 is a front view of the top body shown in FIG. 1 with the lid shown in FIG. 3.

Preferably, as it can be seen in FIGS. 1 and 4, the top body 10 is substantially square and has four corners. There are four sleeves 14 respectively located at the corners of the top body 10. The four sleeves 14 open out downwardly with respect to the top body 10.

Referring now to FIGS. 1, 3, 9, 10, 11, 12 and 13, there is shown that the adjustable level play desk also preferably comprises a substantially rectangular lid 40 for covering the containing section of the top body 10. A hinge is provided for pivotally connecting a first side 42 of the top body 10 with a first side 44 of the lid 40 so that, in operation, the lid 40 is pivoted with respect to the top body 10 by means of the hinge to either open or close the containing section of the top body 10. The first side 42 of the top body 10 has a back wall 30 from which two pairs of inner transversal partition walls 50 extend. Each of the pairs of partition walls 50 has opposite faces which are respectively provided with facing pegs 52. All of the pegs 52 are aligned along a same axis which is offset with respect to the back wall 30. The first side 44 of the lid 40 has an outer back side 54 from which two pairs of inner transversal partition walls 56 extend. Each pair of the partition walls 56 has opposite faces which are respectively provided with opposite recesses 58 adapted to receive the pegs 52 to form the hinge for pivoting the lid 40 with respect to the top body 10. Each partition wall 56 has a back side provided with a curve-shaped hollow 60 above the corresponding recess 58 to receive the upper edge of the back wall 30 when the lid 40 is open.

Figure 10:
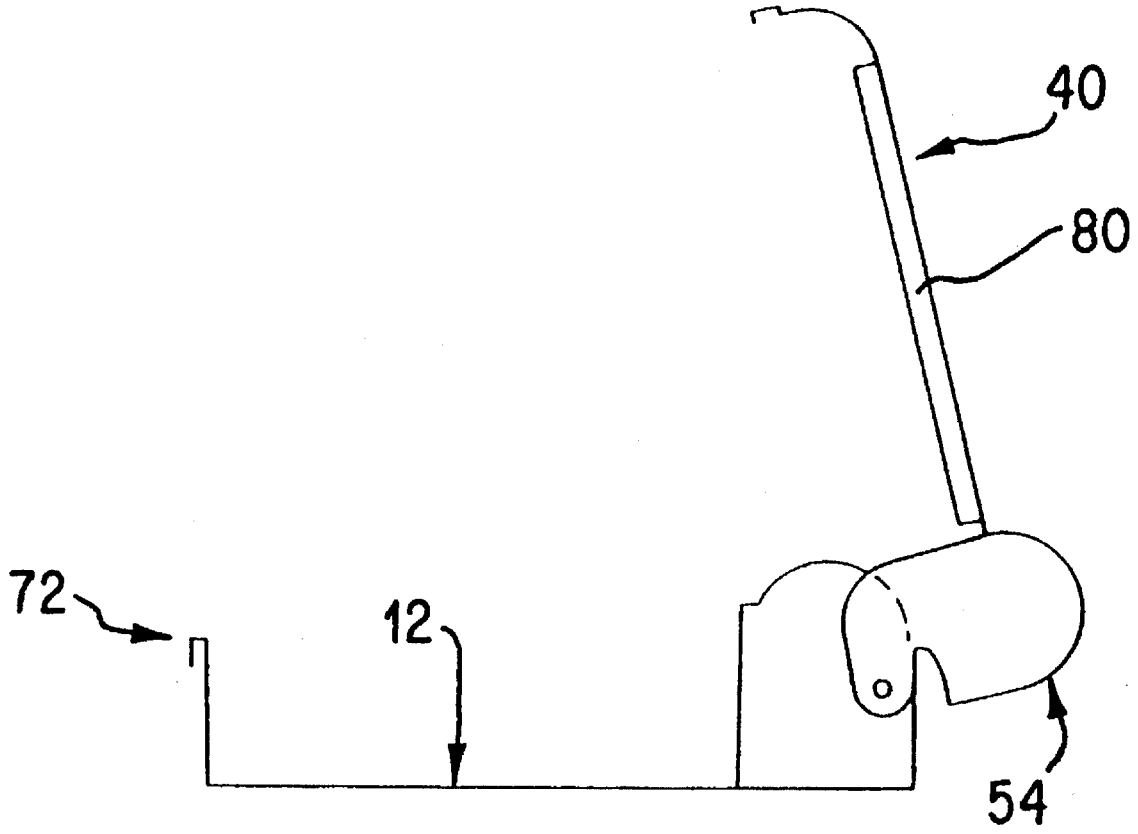
FIG. 10 is a schematic side view of the upper portion of the top body with respect to the lid in a first operating position.
Figure 11:
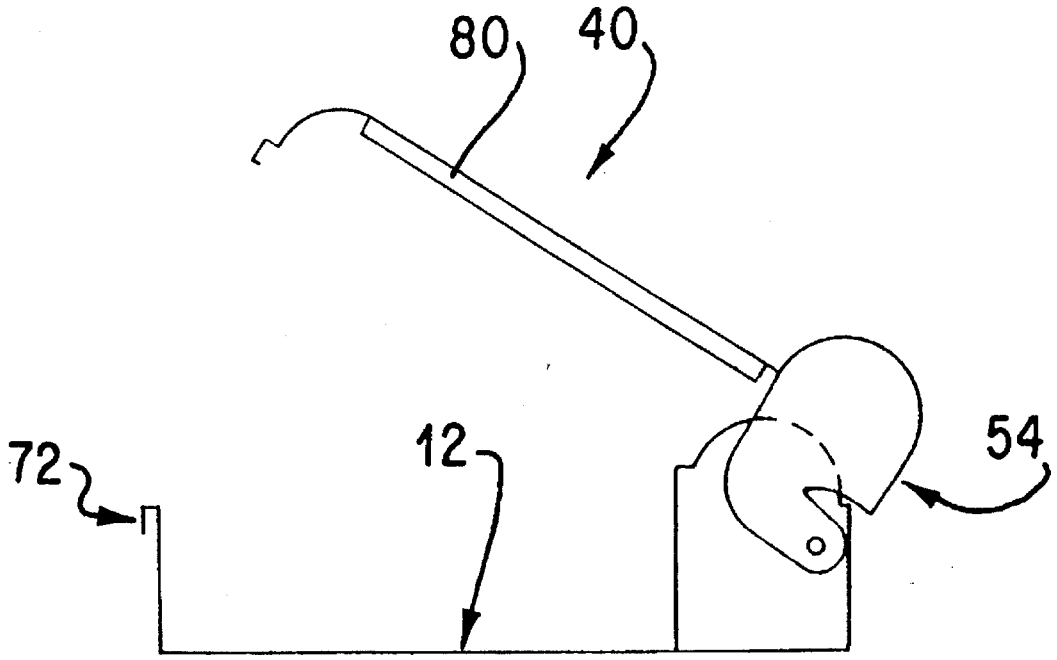
FIG. 11 is the view of FIG. 10 in a second operating position.
Figure 12:
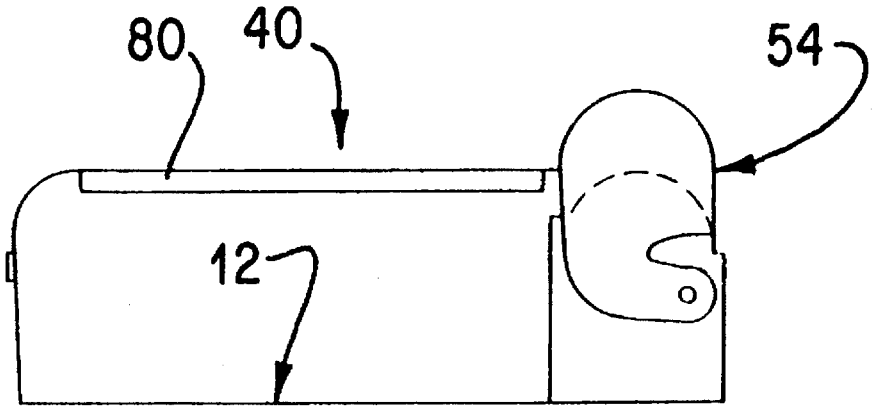
FIG. 12 is the view of FIG. 10 in a third operating position.
Figure 13:
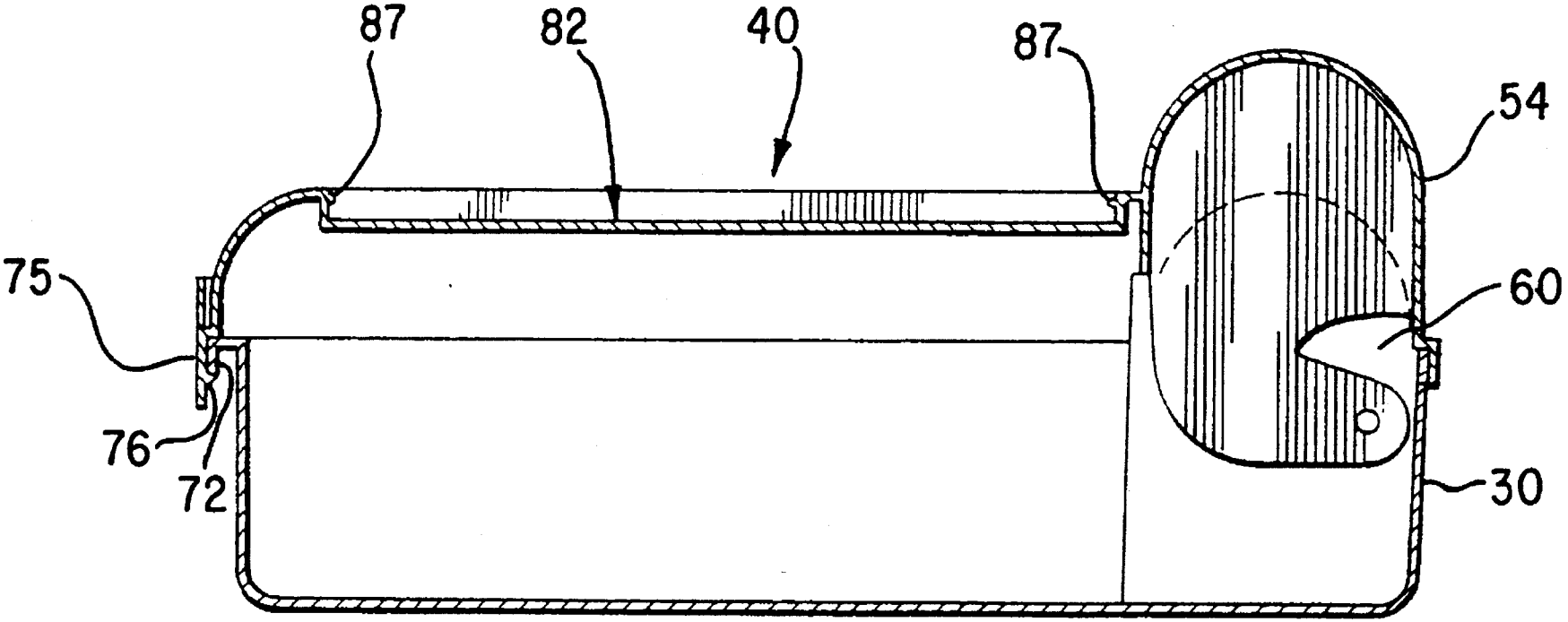
FIG. 13 is a cross section view along lines 13—13 of FIG. 9.

Preferably, the top body 10 has a second side 70 opposite to the first side 42 thereof, which is provided with an outwardly and downwardly projecting edge 72 as shown more specifically on FIGS. 10, 11 and 13. The lid 40 is made of a resilient plastic material and has a second side 74 opposite to the first side 44 thereof. The second side 74 is provided with an inwardly projecting hook 76 shown more specifically on FIG. 13 for snap-fit engagement with the outwardly and downwardly projecting edge 72 of the top body 10 to lock the lid 40 on the top body 10. In use, when the lid 40 closes the containing section, the hook 76 is attached around and under the outwardly and downwardly projecting edge 72 and when the child opens the lid 40 it pulls the second side 74 of the lid 40 by means of a button 75 to slide the hook 76 off the outwardly and downwardly projecting edge 72.

Referring now more specifically to FIGS. 3, 10, 11, 12 and 13, the adjustable level play desk preferably further comprises substantially flat, rectangular play plates 80. The lid 40 comprises a top surface provided with a rectangular-shaped recessed surface 82 having a perimeter edge step 84 provided with an inwardly projecting edge 87 spaced apart from the recessed surface 82. The recessed surface 82 has appropriate dimensions for receiving, side by side, the play plates 80 which, in use, are held in position by means of the inwardly projecting edge 87. The recessed surface 82 is provided with through holes 89 which face respectively the play plates 80 when they are held in position in the recessed surface 82. In use, the child can push each of the plates 80 off position by means of a finger. It can be noted that when the cover is closed, it is not possible to remove the play plates from the lid 40. Accordingly, when the play desk is in store for sale, it is possible to seal the lid 40 on the top body 10 by means of a sticker and even if the play plates are exposed to the customer they cannot be removed from the desk.

Figure 19:
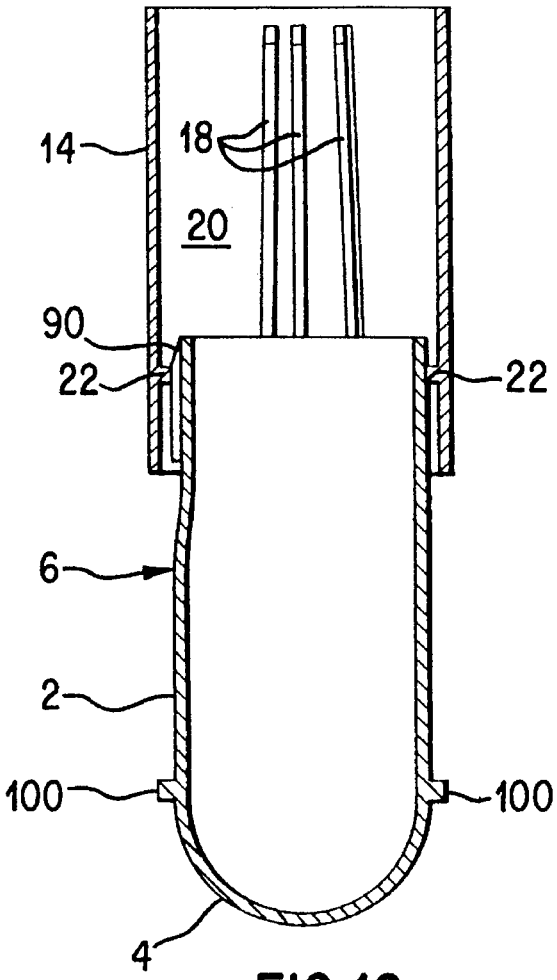
FIG. 19 is a cross section view along lines 19—19 of FIG. 18 in a first operating position.
Figure 20:
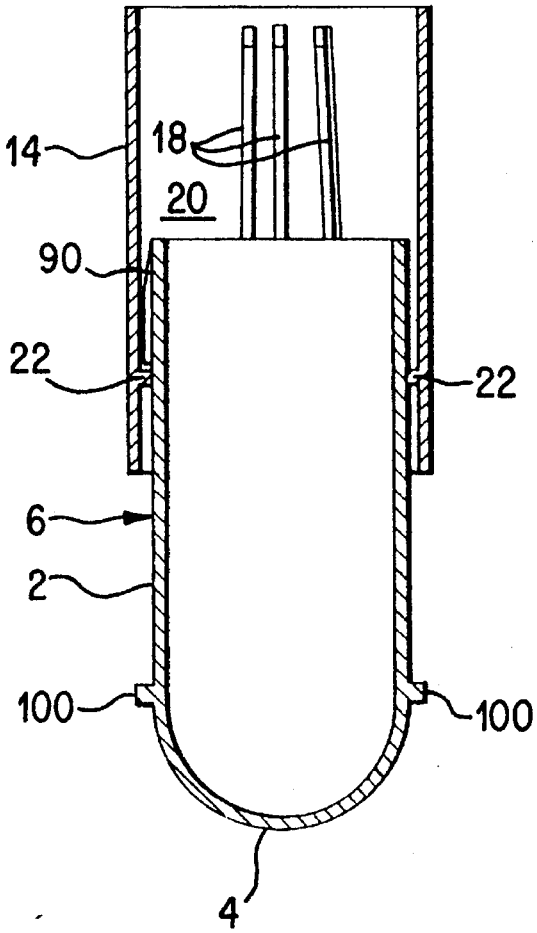
FIG. 20 is the view of FIG. 19 in a second operation position.
Figure 18:
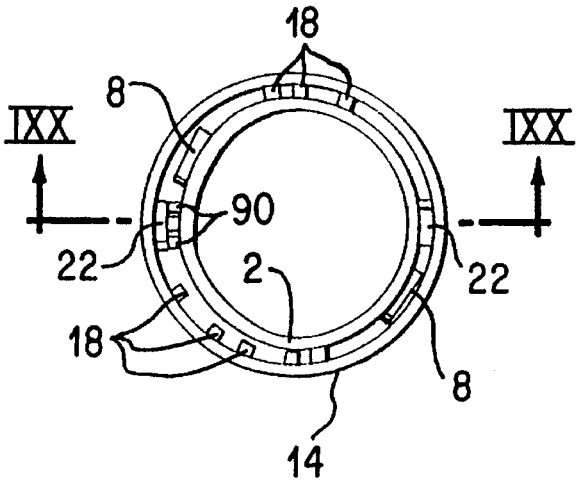
FIG. 18 is a top view of the male and female parts shown in FIG. 16 in a different operating position.

Referring now to FIGS. 18, 19 and 20, there is shown how a leg 2 is initially inserted into a sleeve 14. First, the leg 2 is inserted into the lower opening of the sleeve 14 according to a given position which is determined by the guiding ribs 18. The leg 2 is provided along its length with outer longitudinal ribs 90 having upper bias ends and lower square angle ends which form a stop. In the given position, the ribs 90 face the flanges 22. When the leg 2 is inserted into the sleeve 14, the flanges slide over the ribs 90 via their bias ends, and the leg 2 is momentarily bent out of shape as shown in FIGS. 18 and 19. As the leg 2 is further inserted into the sleeve 14, it will be secured in the sleeve 14 as shown in FIG. 20. In the position shown in FIG. 20, the leg 2 cannot be easily removed from the sleeve 14 because the flanges 22 act like a stop against the lower ends of the ribs 90 to prevent a removal of the leg 2 from the sleeve 14.

Preferably, the top body 10, the legs 2 and the lid 40 are made of plastic material and are produced by moulding.

Although the present invention has been explained hereinafter by way of preferred embodiments thereof, it should be pointed out that any modifications to these preferred embodiments, within the scope of the appended claims, are not deemed to change or alter the nature and scope of the present invention.

What is claimed is:

1. An adjustable level play desk for a child, comprising:

at least three elongated legs of substantially circular cross section, each of the legs having a lower end for resting on the ground and an outer cylindrical surface provided with first locking means, the first locking means comprising spaced apart locking buttons projecting outwardly from the outer cylindrical surface along a longitudinal direction of the leg;

a top body having an upper play surface, and a plurality of sleeves comprising at least three sleeves oriented downwardly when in use, the sleeves being for slidably receiving respectively the legs, the sleeves being solid with the top body at positions providing steadiness thereof, each of the sleeves having:

a lower opening for receiving a corresponding leg, and an inner cylindrical surface provided with second locking means projecting inwardly from the inner cylindrical surface for removably engaging with the first locking means of the corresponding leg upon a predetermined rotation thereof to lock the corresponding leg with respect to the sleeve, and a guiding means for guiding the corresponding leg along a longitudinal direction of the sleeve;

wherein the locking buttons having a round shape such that adjacent facing outer surfaces of the buttons converge to define a curved space between the buttons for guiding the second locking means into a locking position between the spaced buttons, whereby, in operation, the play surface is adjusted with respect to the child according to a given level by sliding and locking the legs with respect to the sleeves.

2. An adjustable level play desk according to claim 1, wherein:

the first locking means comprise at least three aligned, spaced apart locking buttons having a circular shape and projecting outwardly from the outer cylindrical surface along a longitudinal direction thereof;

the guiding means comprise parallel, spaced apart ribs outwardly projecting from the inner cylindrical surface and extending along a longitudinal direction thereof for restricting the buttons along a predetermined path, the predetermined path being wide enough to allow the predetermined rotation; and the second locking means comprise a flange outwardly projecting from the inner cylindrical surface and located within the predetermined path, the flange having a narrow portion corresponding substantially to a distance between two adjacent buttons of said buttons, whereby, in use, one leg is slid into a corresponding sleeve by sliding the buttons of said one leg along the predetermined path of the corresponding sleeve, and said one leg is locked by circumferentially sliding the buttons to lock the flange between two adjacent buttons and wherein the circular shape of the buttons defines the curved space between buttons.

3. An adjustable level play desk according to claim 2, wherein the upper play surface is substantially rectangular and is inwardly projecting in the top body to form a substantially rectangular containing section with an open top, the upper play surface being provided with longitudinal and transversal upwardly projecting flanges to strengthen the top body.

4. An adjustable level play desk according to claim 1, wherein the upper play surface is substantially rectangular and is inwardly projecting in the top body to form a substantially rectangular containing section with an open top, the upper play surface being provided with longitudinal and transversal upwardly projecting flanges to strengthen the top body.

5. An adjustable level play desk according to claim 4, further comprising:

a substantially rectangular lid for covering the open top of the containing section, and a hinge for pivotally connecting a first side of the top body with a first side of the lid so that, in operation, the lid is pivoted with respect to the top body by means of the hinge to either open or close the containing section.

6. An adjustable level play desk according to claim 5, wherein:

the top body has a second side opposite to the first side thereof, which is provided with an outwardly and downwardly projecting edge; and the lid is made of a resilient plastic material and has a second side opposite to the first side thereof, which is provided with an inwardly projecting hook for snap-fit engagement with the outwardly and downwardly projecting edge of the top body for locking the lid on the top body, whereby, in use, when the lid closes the containing section the hook is attached around and under the outwardly and downwardly projecting edge and when the child opens the lid the child pulls the second side of the lid by means of a button to slide the hook off the outwardly and downwardly projecting edge.

7. An adjustable level play desk according to claim 5, further comprising substantially flat, rectangular play plates; wherein:

the lid comprises a top surface provided with a rectangular-shaped recessed surface having a perimeter edge step provided with an inwardly projecting edge spaced apart from the recessed surface, the recessed surface having appropriate dimensions for receiving, side by side, the play plates which, in use, are held in position by means of the inwardly projecting edge; and the recessed surface is provided with at least one through hole that faces at least one of the play plates such that the through hole is covered by the plates when the plates are held in position in the recessed surface, whereby, in use, the child can push each of the plates off position by means of a finger only when the lid is in an open position.

8. An adjustable level play desk according to claim 1, wherein:

the top body is substantially rectangular and has four corners;

the plurality of sleeves include four sleeves respectively located at the corners of the top body; and the four sleeves open out downwardly with respect to the top body.

9. An adjustable level play desk according to claim 1, wherein each of the legs has a spherical lower end to ensure point contact when resting on the ground.

10. An adjustable level play desk according to claim 9, further comprising a stop provided on each leg to prevent the leg from being completely inserted into the corresponding leg.

11. An adjustable level play desk according to claim 10, wherein each of the legs has a spherical lower end and the stop provided on each leg comprises a flange projecting outwardly from the outer surface of the leg at a location separating the spherical lower end of the leg from the outer cylindrical surface of the leg.

12. An adjustable level play desk according to claim 11, wherein the flange projecting outwardly from the outer surface of the leg has a plurality of arcuate cutouts formed therein to enable a child to rotate the leg by grasping the flange.

13. An adjustable level play desk for a child, comprising:

at least three elongated legs of substantially circular cross section, each of the legs having a lower end for resting on the ground and an outer cylindrical surface provided with first locking means;

a top body having an upper play surface, and a plurality of sleeves comprising at least three sleeves oriented downwardly when in use, the sleeves being for slidably receiving respectively the legs, the sleeves being solid with the top body at positions providing steadiness thereof, each of the sleeves having:

a lower opening for receiving a corresponding leg, and an inner cylindrical surface provided with second locking means for removably engaging with the first locking means of the corresponding leg upon a predetermined rotation thereof to lock the corresponding leg with respect to the sleeve, and a guiding means for guiding the corresponding leg along a longitudinal direction of the sleeve, whereby, in operation, the play surface is adjusted with respect to the child according to a given level by sliding and locking the legs with respect to the sleeves;

wherein the upper play surface is substantially rectangular and is inwardly projecting in the top body to form a substantially rectangular containing section with an open top; and a substantially rectangular lid for covering the open top of the containing section, and a hinge for pivotally connecting a first side of the top body with a first side of the lid so that, in operation, the lid is pivoted with respect to the top body by means of the hinge to either open or close the containing section wherein:

the first side of the top body has a back wall from which two pair of first inner transversal partition walls extend, each of the pair of partition walls having opposite faces which are respectively provided with facing pegs, all of the pegs being aligned along a same axis which is offset with respect to the back wall;

the first side of the lid has an outer back side from which two pair of second inner transversal partition walls extend, each of the pair of the second partition walls having opposite faces which are respectively provided with opposite recesses adapted to receive the pegs to form the hinge for pivoting the lid with respect to the top body; and each of the second partition walls has a back side provided with a curve-shaped hollow above a corresponding recess to receive an upper edge of the back wall of the top body when the lid is opened.

14. An adjustable level play desk for a child, comprising:

at least three elongated legs of substantially circular cross section, each of the legs having a lower end for resting on the ground and an outer cylindrical surface provided with first locking means;

a top body having an upper play surface, and a plurality of sleeves comprising at least three sleeves oriented downwardly when in use, the sleeves being for slidably receiving respectively the legs, the sleeves being solid with the top body at positions providing steadiness thereof, each of the sleeves having:

a lower opening for receiving a corresponding leg, and an inner cylindrical surface provided with second locking means for removably engaging with the first locking means of the corresponding leg upon a predetermined rotation thereof to lock the corresponding leg with respect to the sleeve, and a guiding means for guiding the corresponding leg along a longitudinal direction of the sleeve, whereby, in operation, the play surface is adjusted with respect to the child according to a given level by sliding and locking the legs with respect to the sleeves, wherein:

the top body has a back wall and a bottom wall, the back wall has a central portion provided with a first outer opening having appropriate dimensions for receiving a hand of the child;

the bottom wall has a central portion adjacent to the central portion of the back wall, provided with a second outer opening distal from the first opening so that a handle which is between the first and second openings is formed for carrying the desk.

15. An adjustable level play desk for a child, comprising:

a plurality of elongated legs;

a top body having an upper play surface, and a plurality of sleeves oriented downwardly when in use, the sleeves being for slidably receiving respectively the legs, the sleeves being solid with the top body at positions providing steadiness thereof, each of the sleeves having:

a lower opening for receiving a corresponding, leg whereby, in operation, the play surface is adjusted with respect to the child according to a given level by sliding the legs with respect to the sleeves;

wherein the upper play surface is substantially rectangular and is inwardly projecting in the top body to form a containing section with an open top; and a substantially rectangular lid for covering the open top of the containing section, the lid including a top surface provided with a rectangular-shaped recessed surface having a perimeter edge step provided with an inwardly projecting edge spaced apart from the recessed surface and the recessed surface being provided with at least one through hole, and a hinge for pivotally connecting a first side of the top body with a first side of the lid so that, in operation, the lid is pivoted with respect to the top body by means of the hinge to either open or close the containing section; and at least one substantially rectangular play plate; wherein the recessed surface of the lid has appropriate dimensions for receiving the play plates which, in use, is held in position by means of the inwardly projecting edge of the lid so as to cover the through hole such that the play plate is secured in position and, in use, a child's finger cannot extend into the through hole when the plate is in position in the recessed surface and the lid is closed and when the lid is open the child can push the plate away from the recessed surface by means of a finger extended through the through hole from beneath the recessed surface.

16. An adjustable level play desk according to claim 15, wherein the legs have a substantially circular cross section and an outer cylindrical surface and a spherical lower end to ensure point contact when resting on the ground.

17. An adjustable level play desk according to claim 16, wherein each of the legs has a spherical lower end and a stop is provided on each leg to prevent the leg from being completely inserted into the corresponding leg, the stop comprising a flange projecting outwardly from the outer surface of the leg at a location separating the spherical lower end of the leg from the outer cylindrical surface of the leg.

18. An adjustable level play desk according to claim 17, wherein the flange projecting outwardly from the outer surface of the leg has a plurality of arcuate cutouts formed therein to enable a child to rotate the leg by grasping the flange.

19. An adjustable level play desk according to claim 15, further comprising a stop provided on each leg to prevent the leg from being completely inserted into the corresponding leg.

20. An adjustable level play desk according to claim 15, wherein the desk includes a plurality of substantially rectangular play plates; and wherein the recessed surface of the lid has appropriate dimensions for receiving, side by side, the play plates which, in use, are held in position by means of the inwardly projecting edge of the lid so as to cover the through hole such that the play plates are secured in position and, in use, a child's finger cannot extend into the through hole when the plates are in position in the recessed surface and the lid is closed and when the lid is open the child can push at least one of the plates away from the recessed surface by means of a finger extended through the through hole from beneath the recessed surface.

* * * * *